US008508427B2

(12) United States Patent
Deng et al.

(10) Patent No.: US 8,508,427 B2
(45) Date of Patent: Aug. 13, 2013

(54) TRI-COLUMN ADJUSTABLE AZIMUTH BEAM WIDTH ANTENNA FOR WIRELESS NETWORK

(75) Inventors: Gang Yi Deng, Irvine, CA (US); Alexander Rabinovich, Cypress, CA (US)

(73) Assignee: P-Wave Holdings, LLC, Los Angeles, CA (US)

( * ) Notice: Subject to any disclaimer, the term of this patent is extended or adjusted under 35 U.S.C. 154(b) by 690 days.

(21) Appl. No.: 12/359,938

(22) Filed: Jan. 26, 2009

(65) Prior Publication Data

US 2009/0189821 A1 Jul. 30, 2009

Related U.S. Application Data

(60) Provisional application No. 61/062,658, filed on Jan. 28, 2008.

(51) Int. Cl.
*H01Q 3/12* (2006.01)
*H01Q 19/10* (2006.01)

(52) U.S. Cl.
USPC ..... 343/839; 343/761

(58) Field of Classification Search
USPC ..... 343/761, 835, 836, 839, 758, 754, 343/837
See application file for complete search history.

(56) References Cited

U.S. PATENT DOCUMENTS

| | | | | |
|---|---|---|---|---|
| 1,795,397 | A | 3/1931 | Hoyt | |
| 2,473,421 | A | 6/1949 | Fubini et al. | |
| 2,535,049 | A | 12/1950 | De Rosa | |
| 5,949,303 | A | 9/1999 | Arvidsson et al. | |
| 5,966,102 | A | 10/1999 | Runyon | |
| 6,067,053 | A | 5/2000 | Runyon et al. | |
| 7,151,498 | B2 | 12/2006 | Bassily | |
| 7,173,572 | B2 | 2/2007 | Teillet et al. | |
| 2002/0135528 | A1 | 9/2002 | Teillet et al. | |
| 2004/0051677 | A1 | 3/2004 | Gottl | |
| 2007/0008236 | A1 | 1/2007 | Tillery et al. | |
| 2007/0030208 | A1 * | 2/2007 | Linehan | 343/757 |
| 2008/0246681 | A1 | 10/2008 | Deng et al. | |
| 2009/0262039 | A1 | 10/2009 | Lytle et al. | |

OTHER PUBLICATIONS

Office Action dated Jul. 21, 2011 from U.S. Appl. No. 12/157,646.

* cited by examiner

*Primary Examiner* — Robert Karacsony
(74) *Attorney, Agent, or Firm* — OC Patent Law Group

(57) ABSTRACT

A tri-column antenna array architecture, containing a plurality of active radiating elements that are spatially arranged on a modified reflector structure is disclosed. Radiating elements disposed along (P1 and P2) outlying center lines are movable and provided with compensating radio frequency feed line phase shifters so as to provide broad range of beam width angle variation of the antenna array's azimuth radiation pattern.

19 Claims, 7 Drawing Sheets

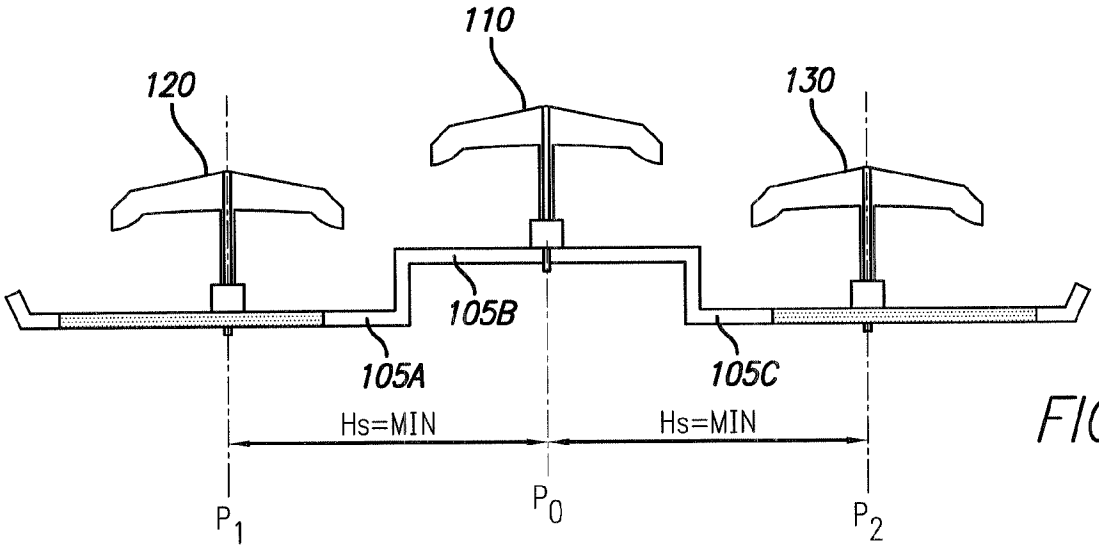
FIG. 2A
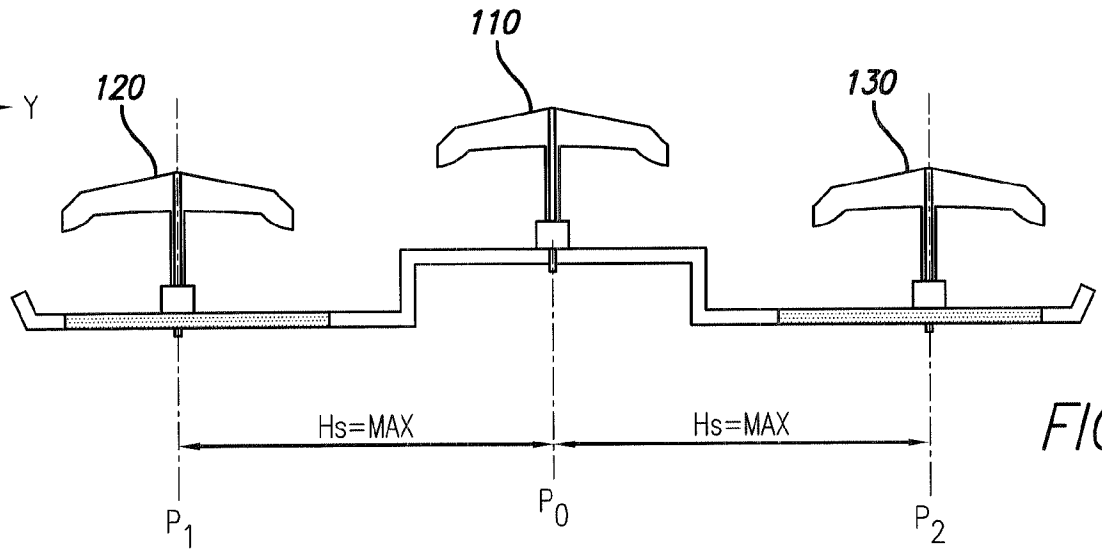
FIG. 2B
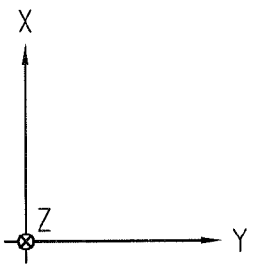

TRI-COLUMN ADJUSTABLE AZIMUTH BEAM WIDTH ANTENNA FOR WIRELESS NETWORK

RELATED APPLICATION INFORMATION

The present application claims the benefit under 35 USC 119(e) of provisional patent application 61/062,658 filed Jan. 28, 2008, the disclosure of which is incorporated herein by reference in its entirety.

BACKGROUND OF THE INVENTION

1. Field of the Invention

The present invention relates in general to communication systems and components. More particularly the present invention is directed to antenna arrays for wireless communication systems.

2. Description of the Prior Art and Related Background Information

Modern wireless antenna implementations generally include a plurality of radiating elements that may be arranged over a ground plane defining a radiated (and received) signal beam width and azimuth scan angle. Azimuth antenna beam width can be advantageously modified by varying amplitude and phase of an RF signal applied to respective radiating elements. Azimuth antenna beam width has been conventionally defined by Half Power Beam Width (HPBW) of the azimuth beam relative to a bore sight of such antenna array. In such antenna array structure radiating element positioning is critical to the overall beam width control as such antenna systems rely on accuracy of amplitude and phase angle of the RF signal supplied to each radiating element. This places severe constraints on the tolerance and accuracy of a mechanical phase shifter to provide the required signal division between various radiating elements over various azimuth beam width settings.

Real world applications often call for an antenna array with beam down tilt and azimuth beam width control that may incorporate a plurality of mechanical phase shifters to achieve such functionality. Such highly functional antenna arrays are typically retrofitted in place of simpler, lighter and less functional antenna arrays while weight and wind loading of the newly installed antenna array can not be significantly increased. Accuracy of a mechanical phase shifter generally depends on its construction materials. Generally, highly accurate mechanical phase shifter implementations require substantial amounts of relatively expensive dielectric materials and rigid mechanical support. Such construction techniques result in additional size, weight, and electrical circuit losses as well as being relatively expensive to manufacture. Additionally, mechanical phase shifter configurations that have been developed utilizing lower cost materials may fail to provide adequate passive intermodulation suppression under high power RF signal levels.

Consequently, there is a need to provide a simpler method to adjust antenna beam width control while retaining down tilt beam capability.

SUMMARY OF THE INVENTION

In a first aspect the present invention provides an antenna for a wireless network comprising a reflector having first, second and third generally planar reflector panels. The antenna further comprises first, second and third columns of plural radiator elements coupled to respective reflector panels with the second column of radiator elements configured between the first and third columns of radiator elements. The first and third radiator elements are movable relative to each other to alter the spacing of the first and third columns of radiator elements.

In a preferred embodiment of the antenna the second plurality of radiator elements may be fixed to the second reflector panel. The first and third reflector panels are preferably generally coplanar. The first and third radiator elements are movable in a direction generally parallel to the planar surfaces of the reflector panels. The first and third reflector panels are preferably configured below the adjacent planar surface of the second reflector panel. If the first and third reflector panel planar surfaces are defined by a Y-axis and a Z-axis parallel to the plane of the reflector surface and an X-axis extending out of the plane of the reflector, the columns of plural radiator elements are parallel to the Z-axis and the radiator elements are movable in the Y direction. The first and third plurality of radiators are preferably aligned in pairs in the Y direction. The second plurality of radiator elements are preferably offset in the Z direction from the first and third radiator element pairs. The first and third columns of radiator elements may for example comprise seven radiator elements in each and the second column of radiator elements may comprise eight radiator elements. The first and third columns of radiator elements are movable in opposite directions to form a wide beam width setting at a first spacing and a narrow beam width setting in a second wider spacing between the two columns. For example, the variable beam width settings may have a variable spacing of about 110 mm to 170 mm between the first and second respective columns and a half power beam width varying from about 105 degrees to 45 degrees.

In another aspect the present invention provides a mechanically variable beam width antenna comprising a reflector structure having plural generally planar reflector panels, the plural reflector panels including a center panel and first and second outer panels, wherein the center panel is configured above the outer panels in a radiating direction. The antenna further includes a first plurality of radiators coupled to the first outer panel and configured in a first column, a second plurality of radiators coupled to the second outer panel and configured in a second column, and a third plurality of radiators coupled to the center panel and configured in a third column. The first and second plurality of radiators are movable relative to each other from a first configuration wherein the first and second columns are spaced apart a first distance in a wide beam width setting to a second configuration where the first and second columns of radiators are spaced apart a second greater distance in a narrower beam width setting.

In a preferred embodiment of the antenna the spacing in the first and second configurations ranges from about 110 mm to about 170 mm. The antenna preferably further comprises an RF feed control circuit for providing unequal RF signal feed between the outer panel radiators which comprise the first and second plurality of radiators and the center panel radiators which comprise the third plurality of radiators. The antenna preferably further comprises an RF phase control circuit for providing an adjustable RF signal phase between the outer panel radiators which comprise the first and second plurality of radiators and the center panel radiators which comprise the third plurality of radiators. The reflector structure preferably has a cross sectional shape wherein the reflector panels form a two level step shape which may have rounded transition regions between the two outer panels and the center panel. The first and second plurality of radiators may be configured in aligned pairs aligned in a direction perpendicular to the columns and the third plurality of radiators are offset from the first and second radiator pairs. The third plurality of radiators may be fixed to the center panel.

In another aspect the present invention provides a method of adjusting signal beam width in a wireless antenna having a plurality of radiators configured on at least three separate reflector panels including two coplanar outer panels and a non-coplanar center panel, wherein radiators on the two outer panels are movable. The method comprises providing the radiators in a first configuration where the outer panel radiators are spaced apart a first distance to provide a first signal beam width and moving the radiators in a direction generally parallel to the coplanar surface of the outer panels to a second configuration spaced apart a second distance to provide a second signal beam width.

In a preferred embodiment the method further comprises providing separate phase adjustment control of the RF signals applied to the radiators on the separate panels to control azimuth beam gradient control.

Further features and advantages of the present invention will be appreciated from the following detailed description of the invention.

BRIEF DESCRIPTION OF THE DRAWINGS

FIG. 2A is a cross section along line A-A in Z-view of the tri-column antenna array in wide azimuth beam width setting (minimum element spacing).

FIG. 2B is a cross section along line A-A in Z-view of the tri-column antenna array in narrow azimuth beam width setting (maximum element spacing).

DETAILED DESCRIPTION OF THE INVENTION

Figure 1:
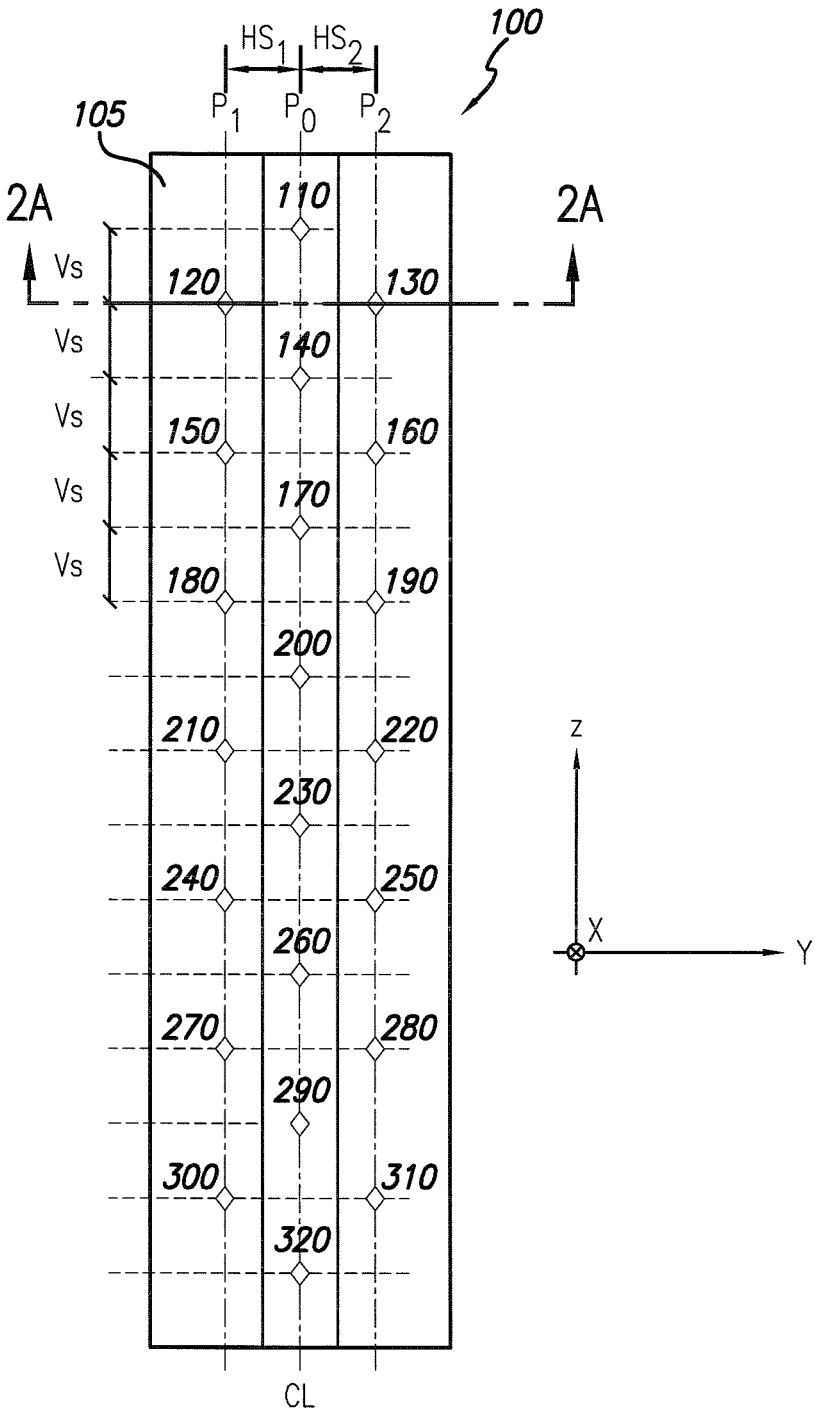
FIG. 1 is a front view of an exemplary tri-column antenna array in accordance with a preferred embodiment of the invention.
Figure 2C:
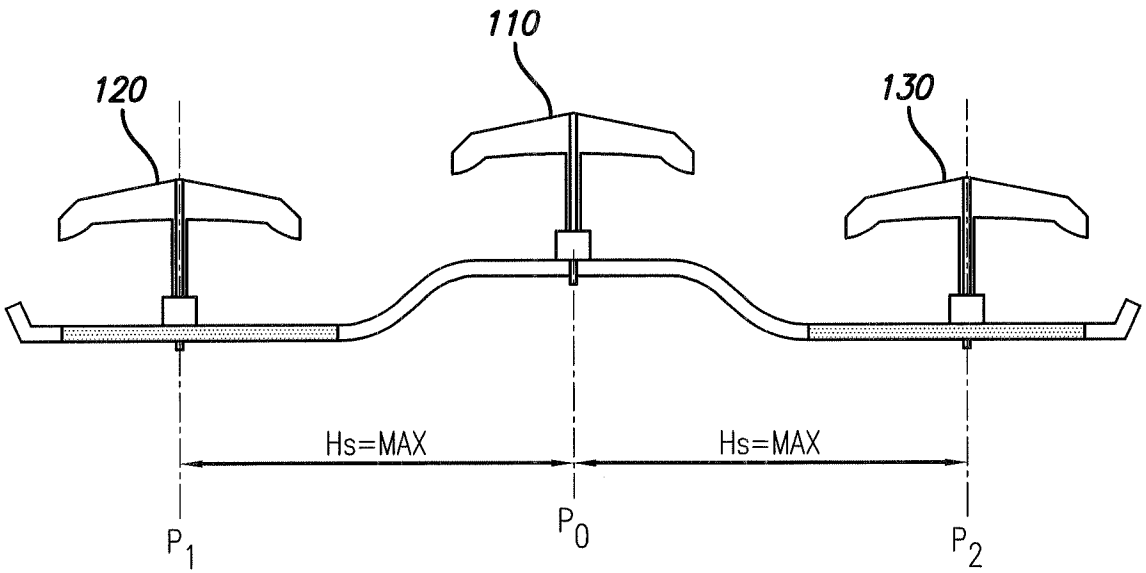
FIG. 2C is a cross section along line A-A in Z-view of a tri-column antenna array in narrow azimuth beam width setting (maximum element spacing) utilizing a 'rolling hills' reflector shape.

FIG. 1, 2A and 2B show a front view and side views of an antenna array, 100, according to an exemplary implementation, which utilizes a modified shape reflector (105A-C). It shall be understood that an alternative number of radiating elements is possible. Reflector, (105 A-C) is longitudinally oriented in a vertical orientation (Z-dimension) of the antenna array (100). The reflector, may, for example, consist of electrically conductive plate or plates suitable for use with Radio Frequency (RF) signals. Further, reflector (105 A-C), plane is shown as a rectangle, but in present practice utilizes an offset planar configuration whereas outer lying portions (105A, 105C) are disposed below center reflector (105B) and fully interconnected. Alternative reflector plane shaping is possible, for example "rolling hills" (FIG. 2C) so as to avoid sharp planar transitions such as shown in FIGS. 2A-B.

The radiating elements are arranged in columns having respective center lines P0, P1 and P2 as shown. Radiating elements disposed on the outer lying reflector portions (or panels) (105A, 105C) are orthogonally movable relative to the center line of respective reflector planes to alter their spacing (to alter P1 & P2 spacing). For example, in an exemplary implementation a total of eight radiating elements (110, 140, 170, 200, 230, 260, 290, 320) are disposed on the center portion of the reflector (105B). The center column radiators are rigidly attached to the center portion of the reflector (105B) which is elevated (in X direction) above the common level plane set forth by (coplanar) outer lying reflectors (105A, 105C) planes. Antenna (100) also employs two sets of seven movable radiating elements. Left most group of seven movable radiating elements (120, 150, 180, 210, 240, 270, 300) are disposed on the left portion of the reflector plate (105A). Right most group of seven movable radiating elements (130, 160, 190, 220, 250, 280, 310) are disposed on the right portion of the reflector plate (105A). The two movable radiating element groups are orthogonally movable relative to center reflector plate center line (P0).

FIG. 2A shows a cross section along A-A datum of FIG. 1 along the y-axis direction. The antenna reflector (105A-C) shape is now clearly identified. In the illustrative non-limiting implementation shown, RF reflector (105A-C), together with plurality of radiating elements (110-320) forms an antenna array useful for RF signal transmission and reception. The outer edge gull wings provide additional pattern augmentation. However, it shall be understood that alternative radiating elements, such as taper slot antenna, horn, patch etc, can be used as well. Even though it is not shown, the present antenna can employ vertically, horizontally or cross polarized radiating elements depending on application requirements.

FIG. 2B shows relative movement of radiating elements with respect to each other in the Y-axis direction. Various implementations for actuating movement of the radiating elements may be employed. For example, the teachings of U.S. patent application Ser. No. 12/080,483, filed Apr. 3, 2008 may be employed, the disclosure of which is incorporated herein by reference in its entirety. Maximum displacement is depicted in FIG. 2B which corresponds to narrow azimuth beam width setting.

Figure 3:
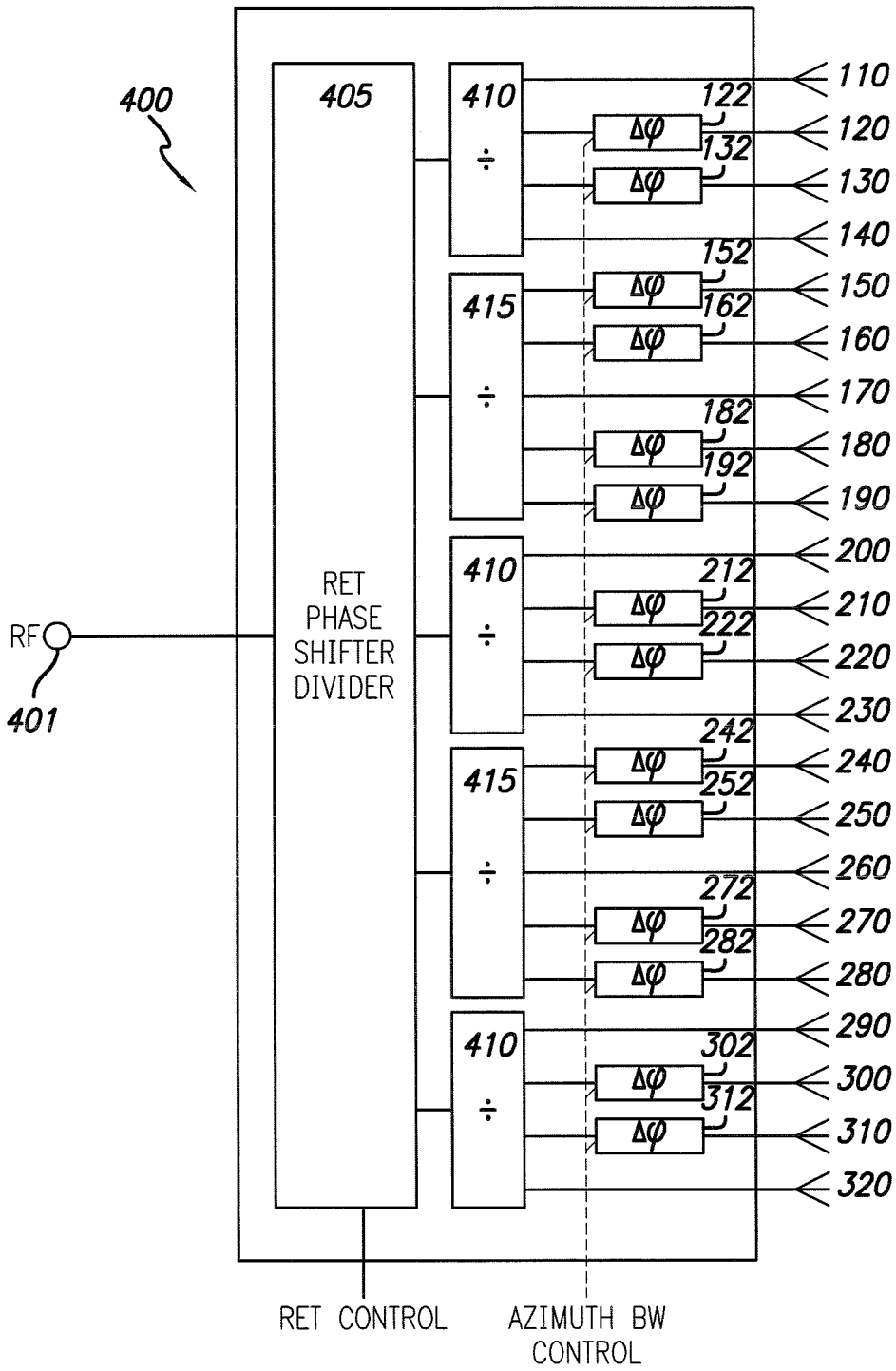
FIG. 3 is a block schematic drawing of an RF feed control unit for a tri-column antenna array with variable down angle tilt and remotely controllable adjustable azimuth beam width control for outlying radiating element RF phase shifters.
Figure 4:
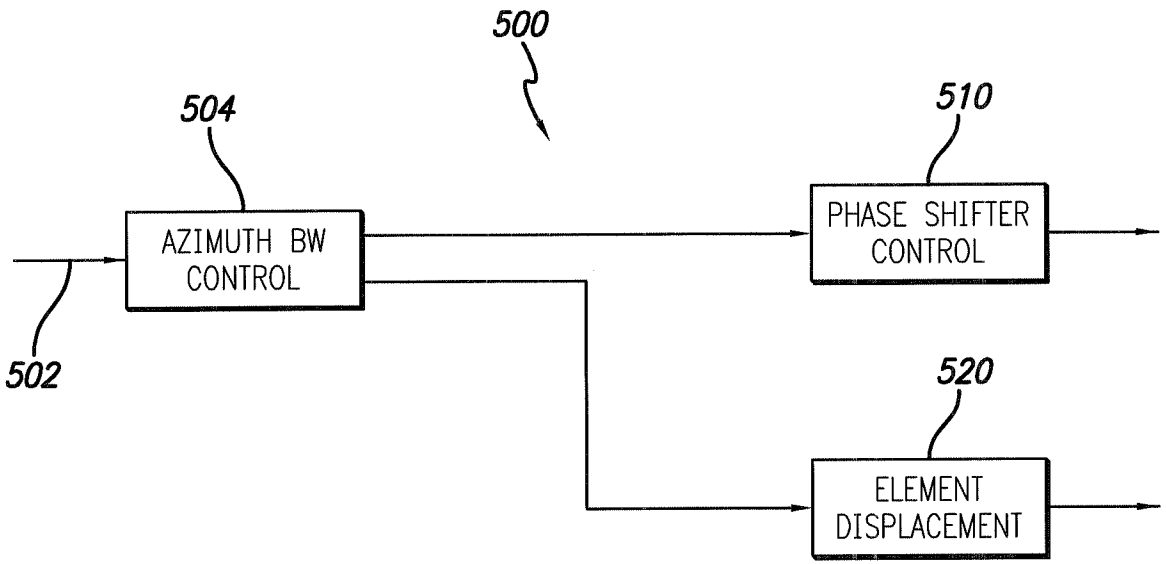
FIG. 4 is a block schematic drawing of an azimuth beam width control system providing mechanical displacement control for radiating elements and phase shifter control.

Referring to FIGS. 3 and 4 beam width control circuitry is illustrated for providing both mechanical and electrical beam width adjustment. Azimuth beam width variation is achieved by providing controlled displacement for RF radiating elements and controlled RF feed phase shift depending on a desired beam width azimuth angle. Azimuth beam width control system 500 (FIG. 4) is remotely or locally controlled by a control signal provided along line 502 and provides control means for controlling radiating elements relative displacement as described above and controlling phase shifters (122 to 312, as shown in FIG. 3). Specifically azimuth beam width controller unit 504 receives the beam width control signal and provides control signals to phase shifter control unit 510 which controls phase shifters in RF feed control unit 400 (FIG. 3) and separately provides control signals to element displacement control unit 520 which controls the displacement of the columns of radiating elements, as illustrated above in FIGS. 2A and 2B.

In FIG. 3, an RF feed control unit for providing electrical beam width control is illustrated in an exemplary embodiment. The input RF signal is provided at RF input 401. To attain wide beam width azimuth control, unequal signal split feed network (400) is utilized. To provide a smooth azimuth angle gradient over wide range azimuth angle settings the outer radiating elements are fed with a lower signal level, for example −7 dB. Conventionally constructed unequal signal splitters (410 and 415) may be utilized. Signals sent to the radiating elements configured on the outer panels are coupled through controllable phase shifters (122, 132 to 302, 312) which receive an azimuth beam width (BW) control signal from control circuit 510. Conventionally constructed controllable phase shifters such as feed line phase shifters may be utilized. RET (Remote Electrical Tilt) phase shifter circuit 405 provides variable down angle (elevational) tilt in response to externally provided RET control signal. RET phase shifter circuit 405 may also be conventionally constructed.

Figure 5:
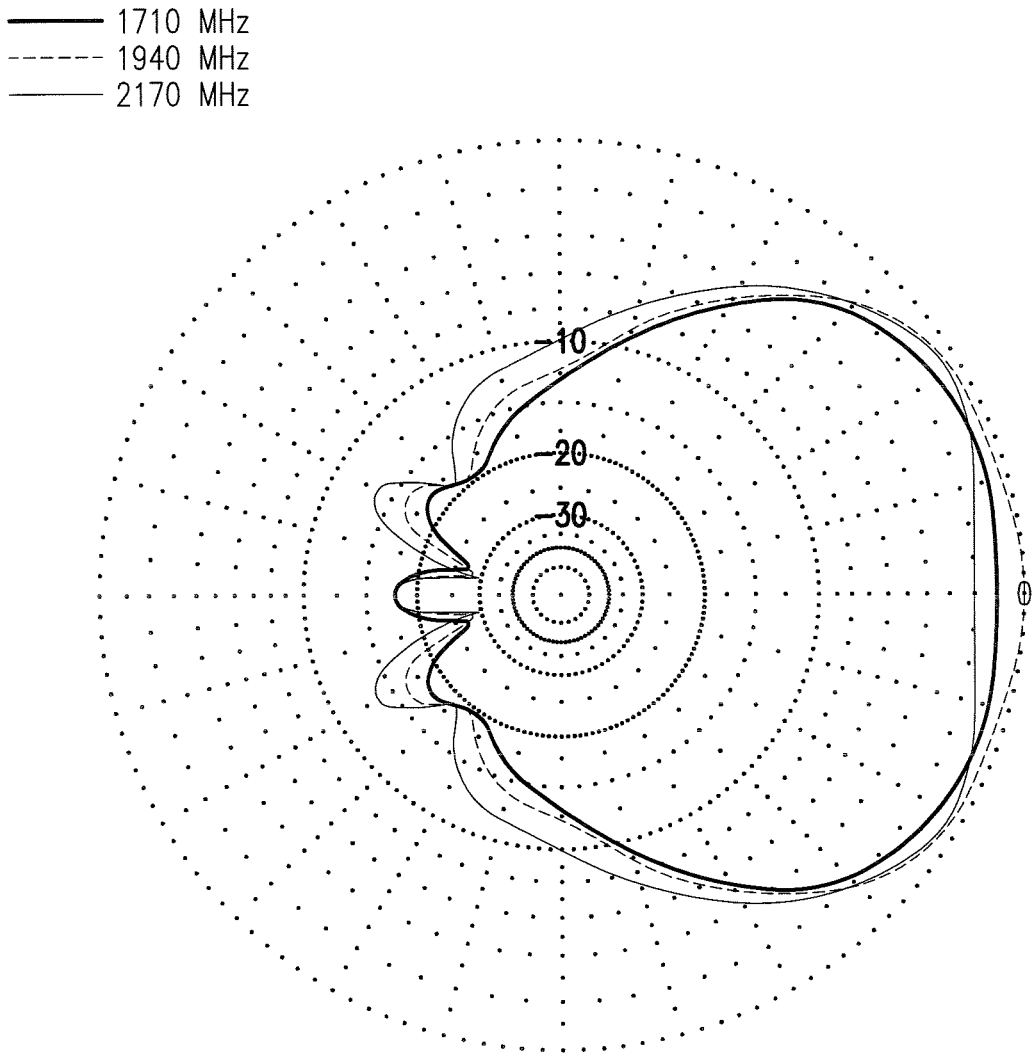
FIG. 5 is a simulated radiation pattern for an exemplary antenna configured for wide azimuth beam width.

Consider a first operational condition for an exemplary implementation wherein the movable RF radiators in the outer panels have right and left group (or column) center lines (P1 and P2) set at 110 mm (minimum separation distance=2× Hs) together with phase shifters set to −45 degree setting (providing phase taper). This results in a wide azimuth beam width of approximately 105 degrees. A simulated radiation pattern for this configuration is shown in the azimuth plot of FIG. 5 (corresponding to X Y plane of FIG. 1, X axis is zero degrees, Y axis 90 degrees). To summarize the results and settings: RF frequencies are 1710 MHz, 1940 MHz and 2170 MHz; elevation angle is 0°; phase taper is −45°, 0°, −45° and amplitude taper: 0.4, 1, 0.4 on the three columns; azimuth beam width range: 102°~109°, outer ring is 16.9 dBi, directivity range: 16.5~17.1 dBi.

Figure 6:
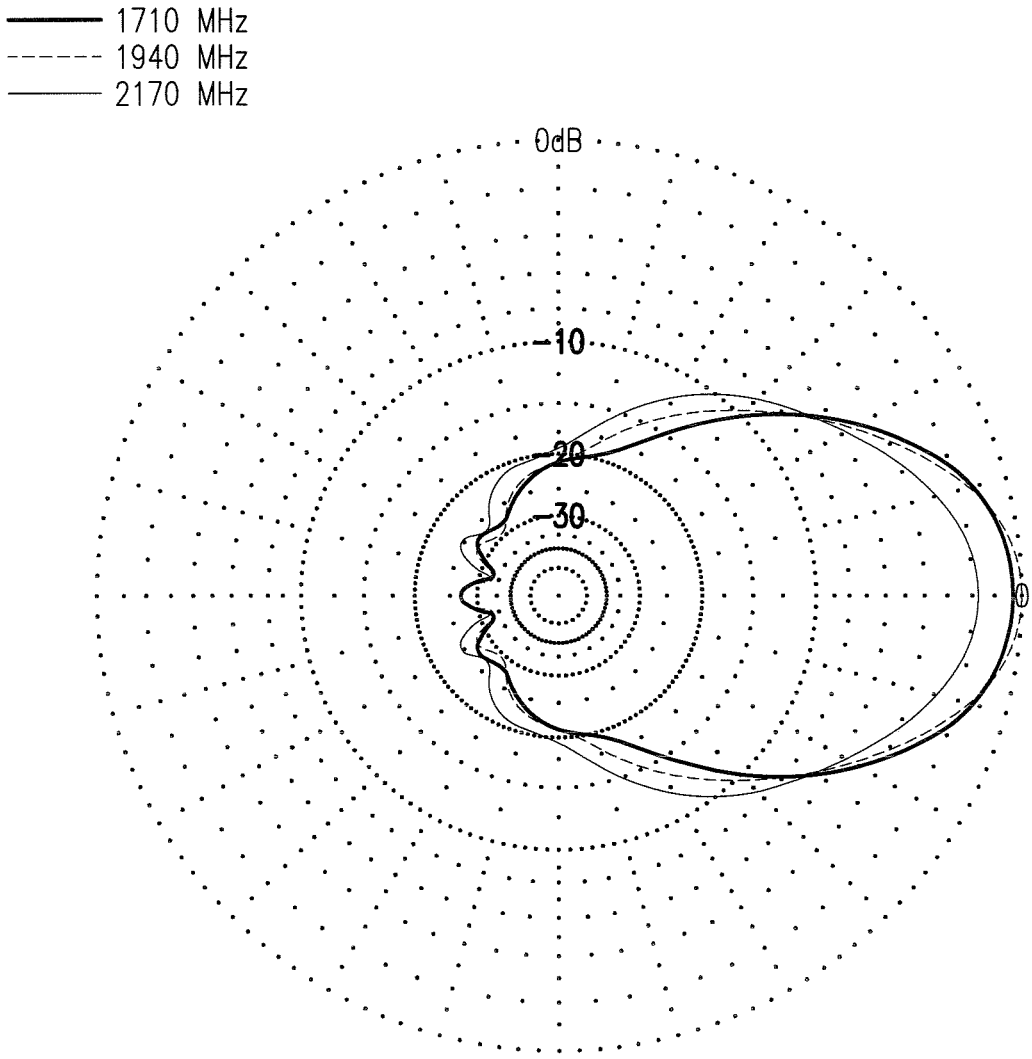
FIG. 6 is a simulated radiation pattern for an exemplary antenna configured for narrow azimuth beam width.

Consider a second operational condition for an exemplary implementation wherein movable RF radiators right and left groups (columns) center lines (P1 and P2) are set at 170 mm (maximum separation distance=2×Hs) together with phase shifters set to 0 degree phase shift setting. This results in narrow azimuth beam width of approximately 45 degrees. A simulated radiation pattern for this configuration is shown in the azimuth plot of FIG. 6 (corresponding to X Y plane of FIG. 1, X axis is zero degrees, Y axis 90 degrees). To summarize the results and settings: RF frequencies are 1710 MHz, 1940 MHz and 2170 MHz; elevation angle is 0°; phase taper is 0°, 0°, 0° and amplitude taper: 0.4, 1, 0.4 on the three columns; azimuth beam width range: 42°~49°, outer ring is 20.27 dBi, directivity range: 18.5~20.3 dBi.

In view of the above it will be appreciated that the invention also provides a method of mechanically adjusting signal beam width in a wireless antenna having a plurality of radiators configured on at least three separate reflector panels including two coplanar outer panels and a non-coplanar center panel by moving the radiators on the outer panels to different configurations providing variable beam width. A method of electrical beam width control is also provided as described above by control of phase shift and amplitude to the radiators.

In view of the above it will be appreciated the invention provides a number of features and advantages including combinational use of radiating element displacement, phase shifter and offset reflector plane for ultra wide range of azimuth adjustability. Further features and aspects of the invention and modifications of the preferred embodiments will be appreciated by those skilled in the art.

What is claimed is:

1. An antenna for a wireless network, comprising:

a reflector comprising first, second and third reflector panels;

first, second and third columns of plural radiator elements coupled to respective reflector panels, the second column of radiator elements configured between the first and third columns of radiator elements;

wherein the first and third radiator elements are movable relative to each other to alter the spacing of the first and third columns of radiator elements, wherein the first and third reflector panels have generally planar surfaces which are defined by a Y-axis and a Z-axis parallel to the plane of the reflector surface and an X-axis extending out of the plane of the reflector, wherein said columns of plural radiator elements are parallel to the Z-axis, and wherein the radiator elements are movable only in the Y direction and the reflector panels are fixed to each other.

2. The antenna of claim 1, wherein said second plurality of radiator elements are fixed to the second reflector panel.

3. The antenna of claim 1, wherein the first and third reflector panels are generally coplanar.

4. The antenna of claim 1, wherein the first and third radiator elements are movable in a direction generally parallel to the generally planar surfaces of the first and third reflector panels.

5. The antenna of claim 4, wherein the first and third reflector panels are configured below the surface of the second reflector panel.

6. The antenna of claim 5, wherein the first and third plurality of radiators are aligned in pairs in said Y direction.

7. The antenna of claim 6, wherein the second plurality of radiator elements are offset in the Z direction from said first and third radiator element pairs.

8. The antenna of claim 7, wherein said first and third columns of radiator elements comprise seven radiator elements in each and wherein said second column of radiator elements comprises eight radiator elements.

9. The antenna of claim 1, wherein said first and third columns of radiator elements are movable in opposite directions to form a wide beam width setting at a first spacing and a narrow beam width setting in a second wider spacing between the two columns.

10. The antenna of claim 9, wherein the variable beam width settings have a variable spacing of about 110 mm to 170 mm between the first and second respective columns and a half power beam width varying from about 105 degrees to 45 degrees.

11. A mechanically variable beam width antenna, comprising:

a shaped single piece reflector structure having a plurality of generally planar reflector panels, the plurality of reflector panels including a center panel and first and second outer panels fixed to each other, wherein the center panel is configured above the outer panels in a radiating direction;

a first plurality of radiators coupled to the first outer panel and configured in a first column;

a second plurality of radiators coupled to the second outer panel and configured in a second column;

a third plurality of radiators coupled to the center panel and configured in a third column;

wherein the first and second plurality of radiators are movable relative to each other from a first configuration wherein the first and second columns of radiators are spaced apart a first distance in a wide beam width setting to a second configuration where the first and second columns of radiators are spaced apart a second greater distance in a narrower beam width setting.

12. The antenna of claim 11, wherein the spacing in said first and second configurations ranges from about 110 mm to about 170 mm.

13. The antenna of claim 11, further comprising an RF feed control circuit for providing unequal RF signal feed between the outer panel radiators comprising said first and second plurality of radiators and the center panel radiators comprising said third plurality of radiators.

14. The antenna of claim 11, further comprising an RF phase control circuit for providing an adjustable RF signal phase between the outer panel radiators comprising said first and second plurality of radiators and the center panel radiators comprising said third plurality of radiators.

15. The antenna of claim 11, wherein the reflector structure has a cross sectional shape wherein the reflector panels form a two level step shape with rounded transition regions between the two outer panels and the center panel.

16. The antenna of claim 11, wherein the first and second plurality of radiators are configured in aligned pairs aligned in a direction perpendicular to said columns and the third plurality of radiators are offset from the first and second radiator pairs.

17. The antenna of claim 11, wherein the third plurality of radiators are fixed to the center panel.

18. A method of adjusting signal beam width in a wireless antenna having a plurality of radiators configured on at least three reflector panels including two coplanar outer panels and a non-coplanar center panel forming a fixed common reflector, wherein radiators on the two outer panels are movable, the method comprising:

providing the radiators in a first configuration where the outer panel radiators are spaced apart a first distance to provide a first signal beam width; and moving the radiators in a direction generally parallel to the coplanar surface of the outer panels to a second configuration spaced apart a second distance to provide a second signal beam width.

19. The method of claim 18, further comprising providing separate phase adjustment control of the RF signals applied to the radiators on the separate panels to control azimuth beam gradient control.

* * * * *